US005193494A

United States Patent [19]

Sono et al.

[11] Patent Number: 5,193,494

[45] Date of Patent: Mar. 16, 1993

[54] VALVE OPERATING SYSTEM FOR INTERNAL COMBUSTION ENGINE

[75] Inventors: Hiroshi Sono; Yasuhiro Urata; Masakazu Kinoshita, all of Saitama, Japan

[73] Assignee: Honda Giken Kogyo Kabushiki Kaisha, Tokyo, Japan

[21] Appl. No.: 579,743

[22] Filed: Sep. 7, 1990

[30] Foreign Application Priority Data

Sep. 8, 1989 [JP] Japan ..... 1-234289
Jul. 27, 1990 [JP] Japan ..... 2-199610

[51] Int. Cl.[5] ..... F01L 9/02
[52] U.S. Cl. ..... 123/90.12
[58] Field of Search ..... 123/90.12, 90.15, 90.16

[56] References Cited

U.S. PATENT DOCUMENTS

| | | | |
|---|---|---|---|
| 4,466,390 | 8/1984 | Babitzka et al. | 123/90.12 |
| 4,674,451 | 6/1987 | Rembold et al. | 123/90.16 |
| 4,696,265 | 9/1987 | Nohira | 123/90.12 |
| 4,716,863 | 1/1988 | Pruzan | 123/90.12 |
| 4,957,075 | 9/1990 | Hasegawa | 123/90.12 |
| 5,002,022 | 3/1991 | Perr | 123/90.12 |

FOREIGN PATENT DOCUMENTS 2907033 9/1980 Fed. Rep. of Germany ... 123/90.12

*Primary Examiner*—Noah P. Kamen
*Attorney, Agent, or Firm*—Lyon & Lyon

[57] ABSTRACT

A valve operating system for an internal combustion engine, including a cam having an arcuate base circle portion with the center thereof being aligned with the rotational axis of the cam and a raised portion projecting radially outwardly from the base circle portion, a cam-side piston operatively connected to the cam, a valve-side piston operatively connected to an engine valve, a hydraulic pressure chamber between the cam-side piston and the valve-side piston, an oil pressure supply source connected to the chamber through a check valve, a hydraulic pressure releasing valve connected to the chamber, and a solenoid valve or the like for controlling the operation of the releasing valve. This solenoid valve or the like is arranged to open the releasing valve to release the hydraulic pressure in the hydraulic pressure chamber in accordance with the operational position of the engine valve. This ensures complete seating of the engine valve and enables part of the working oil in the chamber to be periodically replaced to prevent excessive rise in oil temperature.

6 Claims, 6 Drawing Sheets

VALVE OPERATING SYSTEM FOR INTERNAL COMBUSTION ENGINE

BACKGROUND OF THE INVENTION

1. Field of the Invention

The field of the present invention is a valve operating system for an internal combustion engine wherein the valve operating cam is operatively connected to a cam-side p and a valve-side piston is operatively connected to the engine with a hydraulic pressure chamber provided between the piston and the valve-side piston, and further a hydraulic pressure releasing valve is connected to the hydraulic pres chamber for selectively controlling the operation of the engine valve.

2. Description of the Prior Art

Such valve operating systems are conventionally known, for example, from Japanese Patent Application Laid-Open No. 275516/86. In such a system, the time of actually closing the engine valve can be shifted from the valve closing time defined in accordance with the shape of the valve operating cam by controlling the time of releasing the hydraulic pressure in the hydraulic pressure chamber through a hydraulic pressure releasing valve, thereby providing an engine valve operation mode meeting the operational condition of the engine.

In such valve operating systems, when jumping of the engine valve occurs, a working oil, in response to an increase in the volume of the hydraulic pressure chamber between the valve-side piston and the cam-side piston, is supplied in an amount corresponding to such increase in volume from a pressure oil supply source to the hydraulic pressure chamber. Therefore, if the engine valve is operated in accordance with the shape of the valve operating cam without releasing the hydraulic pressure in the hydraulic pressure chamber, the engine valve remains open or lifted in an amount corresponding to the amount of extra working oil supplied in the above manner, when the cam-side piston engages the base circle portion of the valve operating cam. Thus, complete seating or closing of the engine valve is difficult.

In addition, if the same working oil remains within the hydraulic pressure chamber for a long period of time, the temperature of the working oil is increased, which may cause deterioration of the properties of the working oil.

SUMMARY OF THE INVENTION

It is an object of the present invention to provide a valve operating system for an internal combustion engine, wherein even if jumping of the engine valve occurs, the engine valve can be completely seated. In addition, the working oil in the hydraulic pressure chamber can be replaced to prevent an increase in temperature of the working oil and the attendant deterioration of the properties of the oil.

To achieve the above objects, according to the present invention, control means is arranged to open the hydraulic pressure releasing valve to release the hydraulic pressure in the hydraulic pressure chamber while controlling the valve opening time in the entire operational region for the engine.

With the arrangement of this invention, when the hydraulic pressure releasing valve is controlled in such a manner, the releasing valve may be opened is opened during the entire operational region of the engine. Therefore, the complete seating of the engine valve can be achieved by releasing, through the hydraulic pressure releasing valve, the hydraulic pressure corresponding to the amount of working oil supplied to the hydraulic pressure chamber during the jumping of the engine valve. In addition, an excessive increase in the temperature of the working oil is avoided by continually replacing part of the working oil in the hydraulic pressure chamber.

According to another aspect of the present invention, the raised portion or lobe of the valve-operating cam includes a curved damping portion provided at the terminal end thereof in the direction of rotation of the valve operating cam; and the control means is arranged to open the hydraulic pressure releasing valve to release the hydraulic pressure in the hydraulic pressure chamber with the engine valve being in an operative position corresponding to the curved damping portion. This ensures that in the operational condition where the opening and closing operation mode required for the engine valve is the opening and closing operation mode defined by the valve operating cam (i.e., in an operation condition where the operation mode of the engine valve is not offset from the operation mode defined by the valve operating cam by opening of the hydraulic pressure releasing valve), part of the working oil can be discharged from the hydraulic pressure chamber with a margin and without imposing any influence on the operation of the engine valve by releasing the hydraulic pressure in the hydraulic pressure chamber in a condition corresponding to the curved damping portion where the engine valve is substantially in a closed state. This makes it possible to prevent jumping of the engine valve and to prevent deterioration of the working oil by replacing part of the working oil.

According to a further aspect of the present invention, the control means is arranged to open the hydraulic pressure releasing valve to release the hydraulic pressure in the hydraulic pressure chamber with the engine valve being in an operative position corresponding to the base circle portion in an operational condition where the opening and closing operation mode required for the engine valve is an opening and closing operation mode defined by the valve operating cam. With such arrangement, when the opening and closing operation mode required for the engine valve is the opening and closing operation mode defined by the valve operating cam (i.e., when the operational mode of the engine valve is not offset from the operation mode defined by the valve operating cam by opening the hydraulic pressure releasing valve), part of the working oil can be discharged without imposing any influence on the operation of the engine valve by releasing the hydraulic pressure in the hydraulic pressure chamber, when the engine valve is in an operative condition corresponding to the base circle portion. This makes it possible to prevent jumping of the engine valve and to prevent deterioration of the working oil by replacing part of the working oil.

The above and other objects, features, and advantages of the invention will become apparent from reading the following description of the preferred embodiment, taken in conjunction with the accompanying drawings.

DESCRIPTION OF THE PREFERRED EMBODIMENT

The present invention will now be described in connection with the preferred embodiment with reference to the accompanying drawings.

Figure 1:
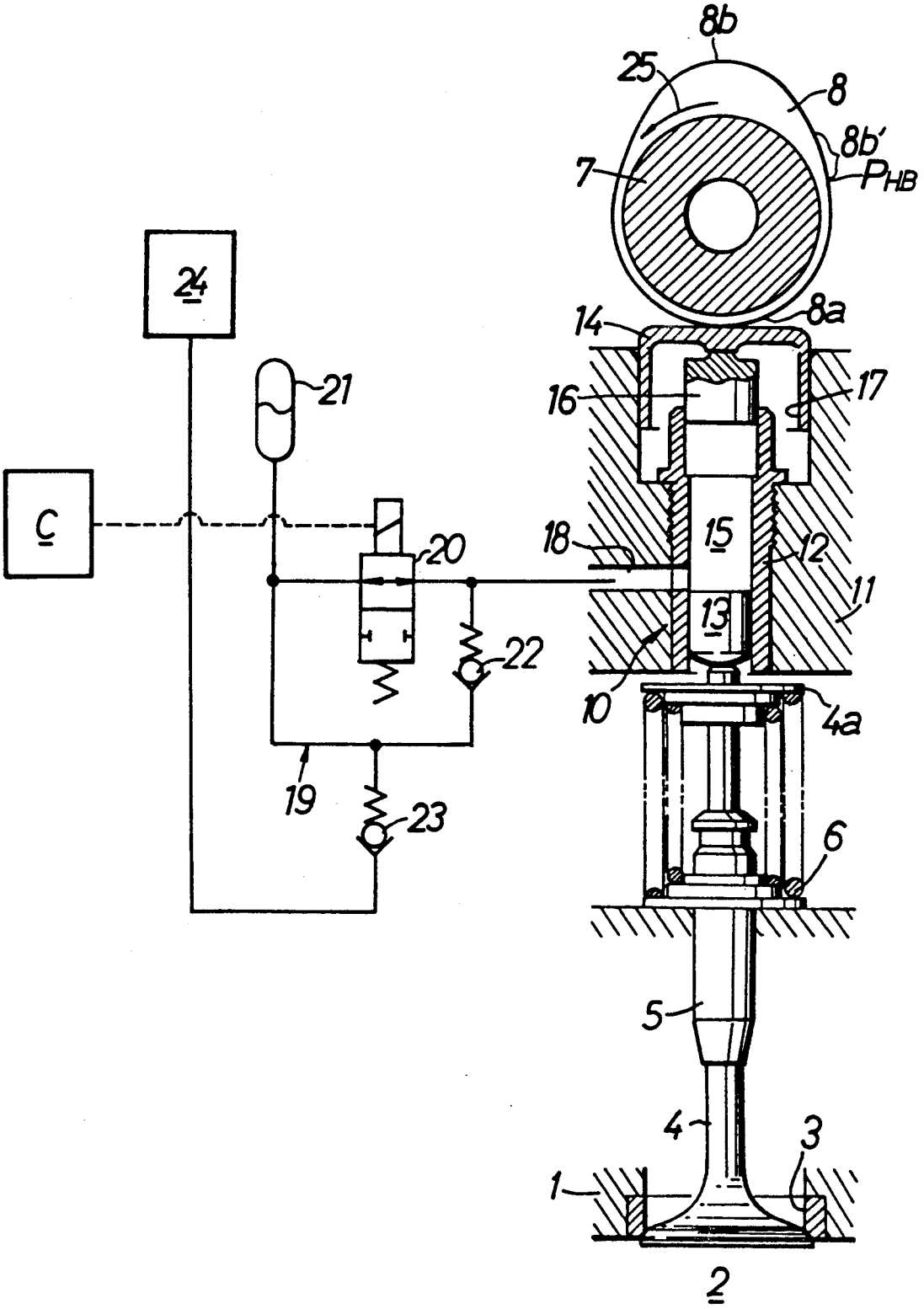
FIG. 1 is a longitudinal sectional view of the valve operating system of a preferred embodiment of the present invention.

Referring first to FIG. 1, a cylinder head 1 of an internal combustion engine is provided with an intake valve opening 3 which opens into a ceiling surface of a combustion chamber 2 defined between the cylinder head 1 and a cylinder block and piston (not shown) and which is in communication with an intake port (not shown). An intake valve 4 is vertically movable and guided by a cylindrical guide 5 provided in the cylinder head 1 to open and close the intake valve opening 3. A valve spring 6 is mounted in a compressed manner between a collar 4*a* provided at an upper or stem end of the intake valve 4 and the cylinder head 1, so that the intake valve 4 is biased upward, i.e., in a closing direction, by the spring force of the valve spring 6. A cam shaft 7 is disposed above the cylinder head 1 and adapted to be rotatably driven by a crankshaft, which is not shown. The cam shaft 7 is integrally provided with a valve operating cam 8. At its outer periphery, the valve operating cam 8 is formed with an arcuate base circle portion 8*a*, concentric with the rotational axis of the valve operating cam 8, and a raised portion 8*b* projecting radially outwardly from the base circle portion 8*a*. At its terminal end in the direction of rotation of the valve operating cam 8, the raised portion 8*b* is provided with a curved damping portion 8*b*′ connected to the base circle portion 8*a* and having a shape effective to substantially close the intake valve 4.

A hydraulic driving mechanism 10 is provided between the valve operating cam 8 and the intake valve 4. The hydraulic driving mechanism 10 is provided above the cylinder head 1 in a support portion 11 fixed to the cylinder head 1 and includes a cylinder 12 fixedly disposed above the intake valve 4 in the support portion 11 with its axis aligned with the opening and closing directions of movement of the intake valve 4. A valve-side piston 13 is slidably received in a lower portion of the cylinder 12 in abutment against the stem end of the intake valve 4. A lifter 14 is provided in sliding contact with the valve-operating cam 8. A cam-side piston 16 is slidably received in an upper portion of the cylinder 12 with its upper end abutting against the lifter 14 to define a hydraulic pressure chamber 15 between the cam-side piston 16 and the valve-side piston 13.

The lifter 14 is formed into a bottomed cylindrical shape and slidably received in a slide hole 17, which is provided coaxially with the cylinder 12 in the upper section of the support portion 11. A central portion of the outer surface of the closed end of the lifter 14 abuts against the valve-operating cam 8, while a central portion of an inner surface of the closed end of the lifter 14 abuts against the cam-side piston 16.

An oil passage 18 is provided in the cylinder 12 and the support portion 11 to communicate with the hydraulic pressure chamber 15, and a closed hydraulic pressure circuit 19 is connected to the oil passage 18. The closed hydraulic pressure circuit 19 comprises a hydraulic pressure releasing valve 20, an accumulator 21, and a first check valve 22, which are connected in sequence; and the oil passage 18 is connected to a junction between the first check valve 22 and the hydraulic pressure releasing valve 20.

The first check valve 22 is disposed in a further oil passage, which connects the accumulator 21 and the oil passage 18 while bypassing the hydraulic pressure releasing valve 20 and permits only a flow of working oil from the accumulator 21 toward the oil passage 18 and blocks a reverse flow of the working oil from the oil passage 18. When the hydraulic pressure in the oil passage 18 is lower by a given value or more than the hydraulic pressure in the accumulator 21, the working oil will flow from the accumulator 21 to the oil passage 18.

An oil pressure supply source 24 is connected to the mentioned further oil passage between the accumulator 21 and the first check valve 22 with a second check valve 23 interposed therebetween. The second check valve 23 permits only a flow of the working oil from the oil pressure supply source 24 and blocks a flow of the working oil toward the oil pressure supply source 24. When the hydraulic pressure in the oil passage between the accumulator 21 and the first check valve 22 is lower by a given value or more than the hydraulic pressure in the oil pressure supply source 24, the working oil will flow through the second check valve 23 into the oil passage between the accumulator 21 and the first check valve 22.

Figure 2:
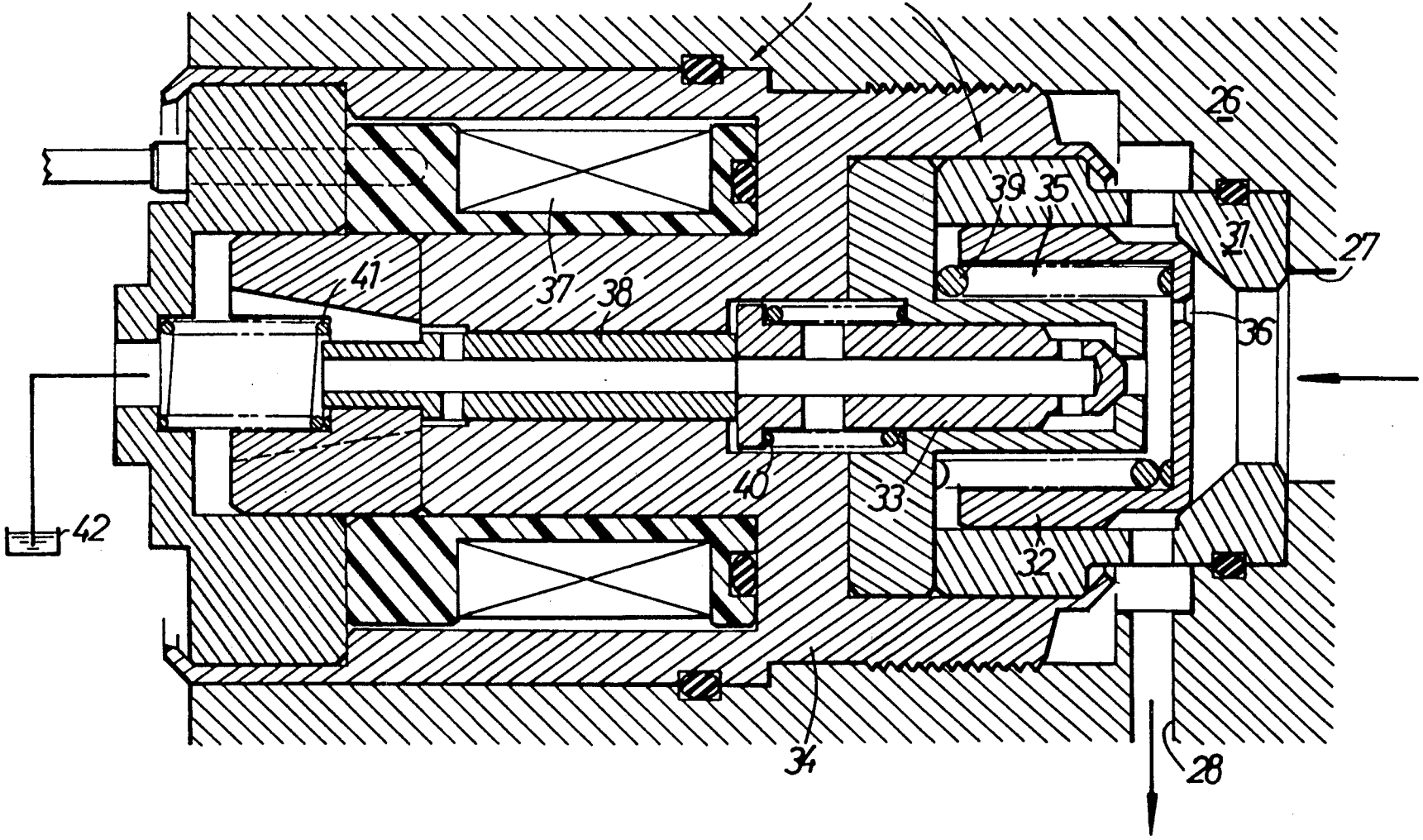
FIG. 2 is a longitudinal sectional view of the hydraulic pressure releasing valve shown diagrammatically in FIG. 1.

Referring also to FIG. 2, the hydraulic pressure releasing valve 20 is controlled in opening and closing operations by a control means C to control the hydraulic pressure in the hydraulic pressure chamber 15; and, for example, the valve 20 may be constructed as a solenoid valve. The hydraulic pressure releasing valve 20 is interposed between a passage 27 provided in a support block 26 in communication with the oil passage 18, and a passage 28 provided in the support block 26 in communication with the accumulator 21. The hydraulic pressure releasing valve 20 is comprised of a control valve portion 29 and a solenoid drive portion 30 for driving the control valve portion 29. The control valve portion 29 comprises a main valve member 32 slidably received in a valve housing 31 for changing over the connection and disconnection between the passages 27 and 28, and a pilot valve member 33 for governing the opening and closing movements of the main valve member 32 mounted in the valve housing 31. The solenoid drive portion 30 is operatively connected to the control valve portion 29 to drive the pilot valve member 33 for opening and closing thereof. More specifically, the valve housing 31 of the control valve portion 29 is coupled to a casing 34 of the solenoid drive portion 30.

The main valve member 32 is of a bottomed cylindrical shape and is slidably received in the valve housing 31. The hydraulic pressure in the passage 27, i.e., the pressure in hydraulic pressure chamber 15, is applied to a front surface of the main valve member 32. A pilot chamber 35 is defined behind the main valve member 32. A spring 39 is contained in the pilot chamber 35 for biasing the main valve member 32 in a direction to cut off the communication between the passages 27 and 28. Therefore, the hydraulic pressure in the passage 27 is applied to the main valve member 32 in a valve-opening direction, and the hydraulic pressure in the pilot chamber 35 and the spring force of the spring 39 are applied to the main valve member 32 in a valve-closing direction. The main valve member 32 is provided with an orifice 36, which permits the passage 27 to communicate with the pilot chamber 35.

The pilot valve 33 is interposed between the pilot chamber 35 and an oil reservoir 42 and biased by a spring 40 in a direction to establish communication between the pilot chamber 35 and the oil reservoir 42. The solenoid drive portion 30 includes a solenoid 37 and a movable core 38 driven by the solenoid 37. The movable core 38 is biased by a spring 41 having a spring force smaller than that of the spring 40 in a direction to coaxially abut against the rear end of the pilot valve member 33. If the solenoid 37 is excited, the movable core 38 urges the pilot valve member 33 in an advancing direction (a rightward direction as viewed in FIG. 2) to its closed position against the spring force of spring 40. If the solenoid 37 is de-excited, the pilot valve member 33 is moved for opening in a retreating direction (a leftward direction as viewed in FIG. 2), which also urges the movable core 38 leftwardly, under the influence of the spring force of spring 40.

In such hydraulic pressure releasing valve 20, if the solenoid 37 of the solenoid drive portion 30 is de-excited, the pilot valve member 33 is opened, so that the working oil in the pilot chamber 35 is delivered into the oil reservoir 42. Thus, the hydraulic pressures acting on the opposite surfaces of the main valve member 32, which are otherwise balanced because of orifice 36, become imbalanced, whereby the hydraulic pressure applied to the front surface of the main valve member 32 overcomes the hydraulic pressure in the pilot chamber 35; and the valve-closing force of the spring 39 to open the hydraulic pressure releasing valve 20 by moving the main valve member 32 to the left, as viewed in FIG. 2.

When the pilot valve member 33 comes to the closed position by excitation of the solenoid 37, the hydraulic pressure in the passage 27 is applied to the pilot chamber 35 through the orifice 36, so that the main valve member 32 is operated in the closing direction (i.e., to the right in FIG. 2) to bring the hydraulic pressure releasing valve 20 into its closed state.

In summary, the oil pressure supply source 24 continually provides working oil through second check valve 23 at a moderate pressure so that after the hydraulic pressure releasing valve 20 has been opened to release the high pressure in chamber 15 that occurs during opening of valve 4, working oil at that moderate pressure will be supplied through the first check valve 22 to chamber 15 when cam 8 is in a position to maintain the valve 4 closed to thereby refill chamber 15, even though releasing valve 20 may, by then, be closed again. When releasing valve 20 opens while the cam 8 is opening valve 4, which produces a high pressure in chamber 15, the high pressure is discharged into accumulator 21.

The control means C is arranged to control the time of opening the hydraulic pressure releasing valve 20 over the entire operational region for the engine, i.e., the time of releasing the hydraulic pressure in the hydraulic pressure chamber 15. This ensures that the time of closing the intake valve 4 can be accurately controlled by controlling the time of opening the hydraulic pressure releasing valve 20 in the entire operational region for the engine.

The curved damping portion 8b' has been described as being provided at the terminal end of the raised portion 8b in the direction of rotation 25 of the valve-operating cam 8. The normal opening and closing operation mode profile for the intake valve 4, which is defined by the shape of cam 8, is as shown by the thicker (lowermost) line in FIG. 3, and there is a damping portion $W_D$ in the opening and closing operation mode profile at a point corresponding to the curved damping portion 8b', i.e., at a location immediately before seating of the intake valve 4. At the damping portion $W_D$, the intake valve 4 is substantially in its closed state. Among the hydraulic pressure releasing times ($\theta_{CE}$, $\theta_{C1}$, $\theta_{C2}$, $\theta_{C3}$, etc.) determined to correspond to the times of closing the intake valve 4 that may be required for improved operation of the engine, the latest hydraulic pressure releasing time $\theta_{CE}$ is established at a location immediately before the starting end of the damping portion $W_D$ and the terminal end position $P_{HB}$ in the direction of rotation 25 of the raised portion 8b of the valve-operating cam 8, i.e., a position of transition from the raised portion 8b to the base circle portion 8a in the rotational direction 25 is established so as to be on the angle side delayed from the latest hydraulic pressure releasing time $\theta_{CE}$ determined by the required performance of the internal combustion engine.

The operation of the invention under a first set of conditions now will be described. When the intake valve 4 is in its fully closed state, the hydraulical driving mechanism 10 is in a state as shown in FIG. 1. When the valve-operating cam 8 is rotated from this state, the cam-side piston 16 is urged downwardly by the raised portion 8b to tend to reduce the volume of the hydraulic pressure chamber 15. At this time, the hydraulic pressure releasing valve 20 is in its closed state. Therefore, the movement of the cam-side piston 16 causes the hydraulic pressure in the hydraulic pressure chamber 15 to be increased and, in response to such increased hydraulic pressure, the valve-side piston 13 is urged downwardly, so that the intake valve 4 is opened against the spring force of valve spring 6. When the urging force applied to the lifter 14 by the raised portion 8b of the valve operating cam 8 is released, the intake valve 4 is driven upwardly, i.e., in a closing direction under the influence of the spring force of valve spring 6; and the valve-side piston 13, the cam-side piston 16, and the lifter 14 are also urged upwardly. During this closing operation of intake valve 4, because the hydraulic pressure releasing valve 20 is operated and opened, the hydraulic pressure in the hydraulic pressure chamber 15 is released, which permits the valve-side piston 13 to be moved toward the cam-side piston 16 in an amount corresponding to the released hydraulic pressure. Therefore, the closing times for the intake valve 4 corresponding to the hydraulic pressure releasing times ($\theta_{CE}$, $\theta_{C1}$, $\theta_{C2}$, $\theta_{C3}$, etc.) are determined as shown in FIG. 3 and can be offset from the time determined by the shape of the raised portion 8b of the valve-operating cam 8.

As a result of this ability to release the oil pressure, it is possible to replace part of the working oil in the hydraulic pressure chamber 15 to prevent an excessive increase in its temperature and the attendant deterioration of properties thereof by controlling the opening time of the hydraulic pressure releasing valve 20 in the entire operational region of the engine. Moreover, because part of the working oil can be discharged to the oil reservoir 42 during opening of the hydraulic pressure releasing valve 20, the replacement of the working oil can be smoothly conducted.

Figure 3:
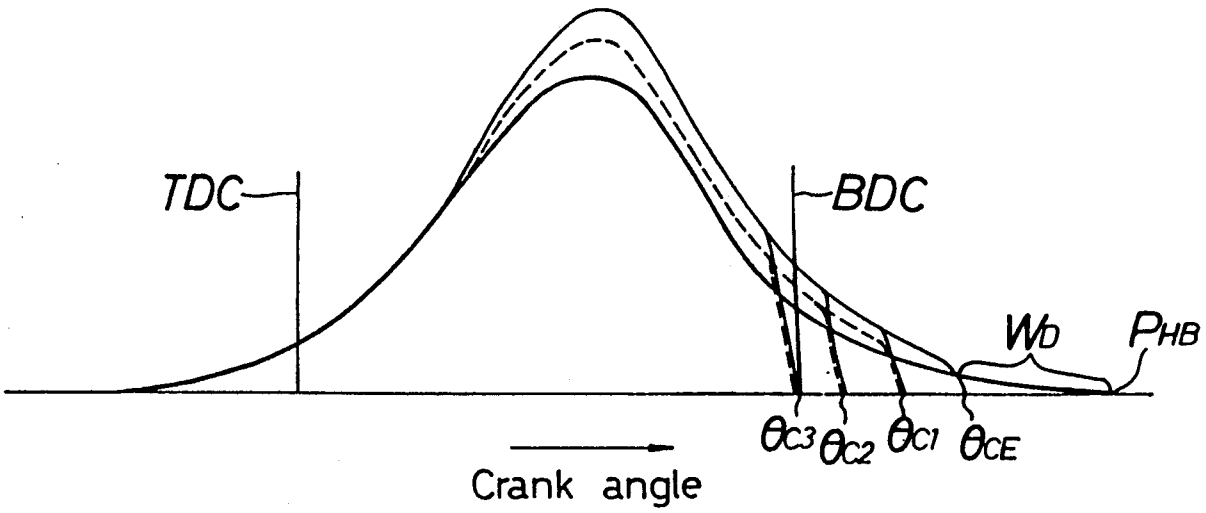
FIG. 3 is a graph illustrating the operational characteristics of the intake valve under a first set of operating conditions.

For example, assume that during opening of the intake valve 4 a jumping has occurred as shown by either the curved dotted line or the curved thinner solid line in FIG. 3, the working oil supplied from the oil pressure supply source 24 into the hydraulic pressure chamber 15 due to the jumping can be allowed to escape; and the intake valve 4 can be completely seated, because the closing times are determined by releasing the hydraulic pressure in the hydraulic pressure chamber 15 through the hydraulic pressure releasing valve 20. Moreover, the surplus working oil provided due to the jumping can be smoothly discharged by discharging part of the working oil to the oil reservoir 42 through the hydraulic pressure releasing valve 20.

In addition, any reduction in output power from the engine is avoided because the terminal end position $P_{HB}$ of the raised portion 8b is established on the angle side delayed from the latest hydraulic pressure releasing time $\theta_{CE}$ determined by the required performance of the internal combustion engine. In contrast, if the terminal end position $P_{HB}$ coincides with the latest hydraulic pressure releasing time $\theta_{CE}$ or is on the side of an angle advanced from the latest hydraulic pressure releasing time $\theta_{CE}$, a reduction in output power from the engine may occur.

Although the above first embodiment has been described for controlling the intake valve 4 in which the closing time of the intake valve 4 is determined by the control of the opening of the hydraulic pressure releasing valve 20, second and third embodiments will be described below in which the opening of hydraulic pressure releasing valve 20 is controlled to compensate for the jumping of the intake valve 4 and to replace the working oil in an operational condition where the opening and closing operation mode required for the intake valve 4 from the engine is an opening and closing mode defined by the valve-operating cam 8, i.e., in an operational condition where the operational mode of the intake valve 4 is not offset from the operational mode defined by the valve-operating cam 8 through opening of the hydraulic pressure releasing valve 20.

Figure 4:
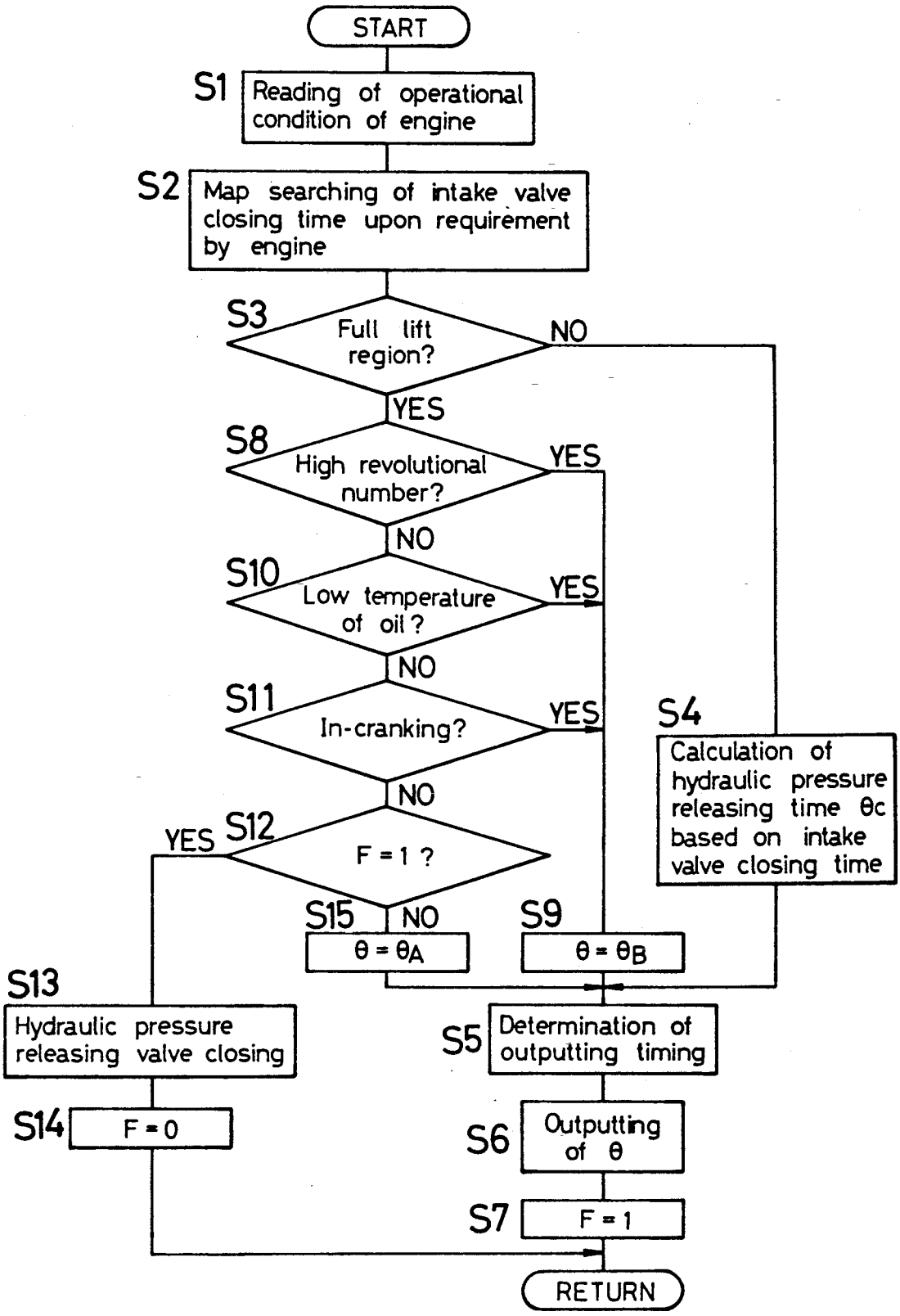
FIG. 4 is a flow chart illustrating the controlling procedure for the system of this invention.
Figure 5:
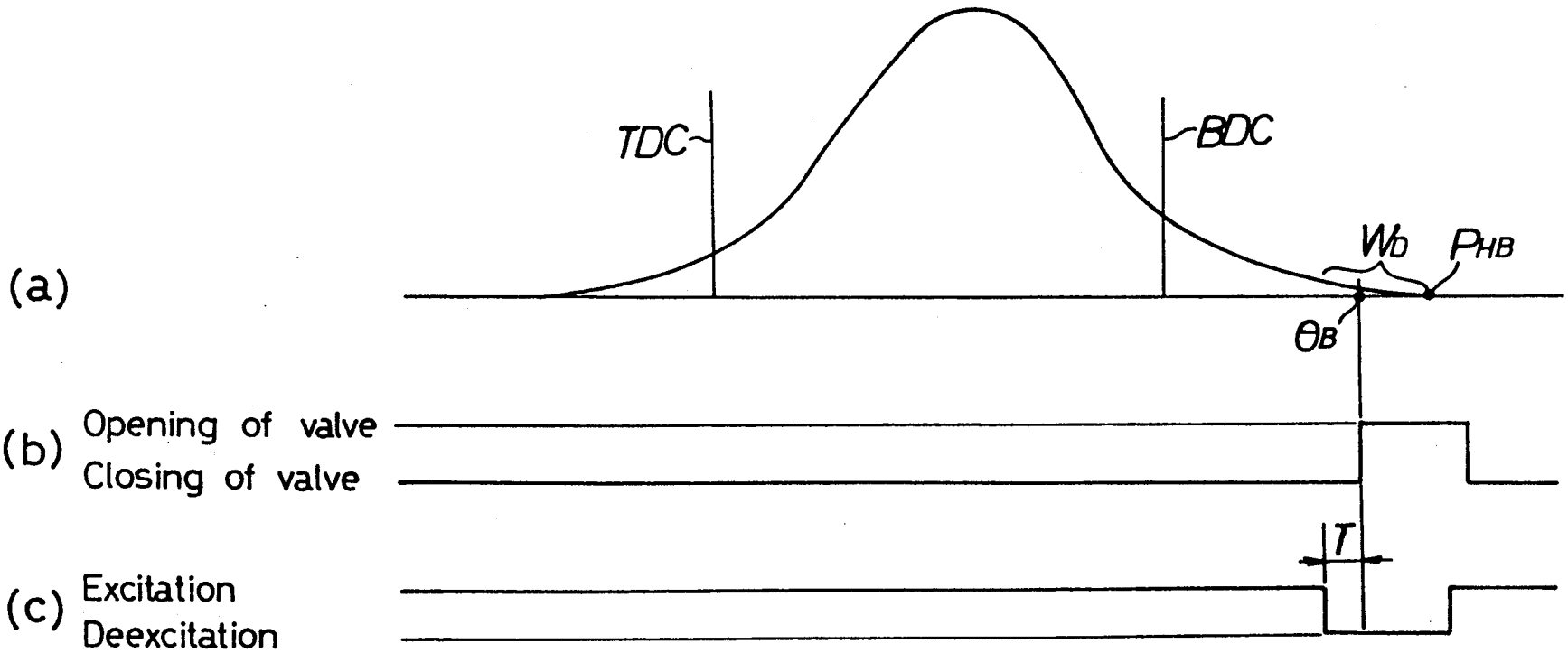
FIG. 5 is a diagram similar to FIG. 3 illustrating the controlled valve timing under a second set of operating conditions.

Referring next to FIGS. 4 and 5, the controlling procedure of the present invention will be described in connection with a second set of operating conditions, with FIG. 4 being a flow chart illustrating the controlling procedure and FIG. 5 being a graph illustrating the controlled timing.

Referring first to FIG. 4, the controlling procedure is shared with each TDC signal, meaning a signal produced to indicate the "Top Dead Center" position of the crankshaft at the start of the intake stroke. At the first step S1, the operational condition of the engine, such as the number of revolutions of the engine per minute, the opening degree of the throttle valve, the temperature of the working oil, the atmospheric pressure, the atmospheric temperature, and the on-off state of a starter are read. This data is stored at all times in a portion of the control means C and read from a RAM location in response to the TDC signal.

At the second step S2, the closing time for the intake valve 4 based on the requirements of the engine is determined by searching a map previously defined on the basis of the number of revolutions of the engine per minute and the opening degree of the throttle valve. At the third step S3, on the basis of the result of searching from the map, it is judged whether the opening and closing operation mode of the intake valve 4 is of a full lift, i.e., whether the operational condition is such that the opening and closing operation mode of the intake valve 4 is an opening and closing operation mode defined by the valve-operating cam 8 without controlling the hydraulic pressure releasing valve 20 for opening thereof.

When the result of step S3 is "no," the opening and closing operation mode is not in a full lift region (i.e., the operational condition is in an operational region where the closing time for the intake valve 4 is established by opening the hydraulic pressure releasing valve 20), and the processing is advanced from the third step S3 to the fourth step S4. At this fourth step S4, the hydraulic pressure releasing time $\theta_C$ corresponding to the closing time for the intake valve 4 is determined by searching a map while incorporating correction thereinto in view of possible discrepancy in the operation of the hydraulic pressure releasing valve 20, which may occur due to other conditions, such as the temperature of the working oil or the atmospheric pressure and temperature.

At the fifth step S5, the timing of outputting the hydraulic pressure releasing time $\theta$ (i.e., the time a de-exciting signal is provided to solenoid 37 (see FIG. 2) to open the hydraulic pressure releasing valve 20) is determined by the number of revolutions of the engine per minute and the temperature of the working oil, taking into account any delay of operation or the like, that will occur for example, when the engine is operated at a high speed and the temperature of the working oil is low. At the sixth step S6, the hydraulic pressure releasing time $\theta$ is outputted; and then, at the seventh step S7, a flag F is set to "1". The flag F is used for a judgment at a twelfth step S12, which will be described hereinafter. When the hydraulic pressure releasing valve 20 has been opened, the flag becomes "1".

If the result of step S3 is "yes," then the opening and closing mode of the intake valve 4 is in the full lift region and processing is advanced to the eighth step S8 at which it is judged whether or not the detected number of revolutions of the engine per minute is higher than a given number. If the detected number of revolutions of the engine per minute is higher (i.e., "yes" at step S8), the processing is advanced to the ninth step S9 at which the hydraulic pressure releasing time $\theta$ is established as $\theta_B$. The hydraulic pressure releasing time $\theta_B$ is established to lie in a damping portion $W_D$ corresponding to the curved damping portion 8b' located at the terminal end of the raised portion 8b in the direction of rotation 25 of the valve-operating cam 8, when the opening and closing operation mode profile of the intake valve 4 defined by the valve-operating cam 8 is as shown in FIG. 5.

After the hydraulic pressure releasing time $\theta_B$ has been established at the ninth step S9, the outputting timing is decided at the fifth step S5. The de-exciting signal provided to open the hydraulic pressure releasing valve 20 as a result of this decision of the outputting timing is outputted from the control means C in advance by an amount of time T prior to the hydraulic pressure releasing time $\theta_B$, as shown in FIG. 5*c*.

When the eighth step S8 is "no," the detected number of revolutions of the engine is not higher than the given number; and the processing is advanced to the tenth step S10. At S10 it is determined whether the temperature of the working oil is lower than a preselected level. If the temperature of the working oil is lower (i.e., "yes"), the processing is advanced to the ninth step S9, and if the temperature of the working oil is not lower (i.e., "no"), the processing is advanced to the eleventh step S11. At the eleventh step S11, it is judged on the basis of the on-off signal of the starter whether the engine is in cranking. If the engine is in cranking (i.e., "yes"), the processing is advanced to the ninth step S9, and if the engine is not in cranking (i.e., "no"), the processing is advanced to the twelfth step S12.

In an operational condition where the intake valve 4 is in an opening and closing operation mode, with a full lift due to a requirement from the engine, the time of opening the hydraulic pressure releasing valve 20 (i.e., the hydraulic pressure releasing time $\theta_B$) is established at the damping portion $W_D$ in a specific operational region where the number of revolutions of the engine per minute is equal to or more than a preset number, or in a specific operational region where the temperature of the working oil is equal to or less than a preset temperature, or in a specific operational region where the engine is in cranking. This ensures that with the intake valve 4 substantially closed, the working oil can be discharged from the hydraulic pressure chamber 15 to prevent any jumping of the intake valve 4 and to provide replacement of the working oil. Moreover, the time required to supply the working oil to the hydraulic pressure chamber 15 is extremely short in the specific operational region where the number of revolutions of the engine per minute is equal to or more than the preset number, whereas the time required to supply the working oil to the hydraulic pressure chamber 15 is relatively long in the specific operational region where the temperature of the working oil is equal to or less than the preset temperature, because the working oil is highly viscous. Further, the time required to supply the working oil to the hydraulic pressure chamber 15 is relatively long in the specific operational region where the engine is in cranking, because the pressure of the working oil is low. According to this embodiment, however, by establishing the hydraulic pressure releasing time $\theta_B$ at the damping portion $W_D$, the time till the start of opening of the intake valve 4 can be relatively prolonged to permit a reliable supply of the working oil.

At the twelfth step S12, it is judged whether the flag F is at "1". The flag F is set at "1" at the seventh step S7 after the hydraulic pressure releasing time $\theta$ has been outputted at the sixth step S6 to open the hydraulic pressure releasing valve 20. When the hydraulic pressure releasing valve 20 has been opened and the flag F has been set to "1" at a preceding control procedure, the processing is advanced from the twelfth step S12 to the thirteenth step S13. At the thirteenth step S13, the hydraulic pressure releasing valve 20 is left closed. At a fourteenth step S14, the flag F is set to "0".

On the other hand, if the decision is "no" at the twelfth step S12 (i.e., the flag F is not at "1"), the hydraulic pressure releasing time $\theta$ is set at $\theta_A$ at a fifteenth step S15, and the fifth step S5 is executed. The hydraulic pressure releasing time $\theta_A$ relates to an operational region excluding the specific operational region where the number of revolutions of the engine per minute is equal to or more than the preset number, or the specific operational region where the temperature of the working oil is equal to or less than the preset temperature, or the specific operational region where the engine is in cranking, in the operational condition where the intake valve 4 is in an opening and closing operation mode with a full lift. The hydraulic pressure releasing time $\theta_A$ may be a time when the intake valve 4 is in an operational region corresponding to the base circle portion 8*a*, or may be identical with the hydraulic pressure releasing time $\theta_B$.

If the control is carried out according to such a procedure, the working oil can be discharged outside in the operational condition where the intake valve 4 is in an opening and closing operation mode with a full lift in such a manner that no adverse influence is exerted on the operation of the intake valve 4, thereby preventing jumping of the intake valve 4 and avoiding an excessive increase in temperature of the working oil by the replacement of part of the working oil to prevent any deterioration of the working oil. Moreover, in a condition where the intake valve 4 is in the opening and closing operation mode with a full lift in the operational region excluding the above-described operational regions, releasing of the hydraulic pressure is conducted for every two control cycles. Therefore, it is possible to provide a reduction in load on the hydraulic pressure releasing valve 20, a reduction in wear of the sliding portions of the hydraulic pressure releasing valve 20, and a reduction in noise attendant to the opening of the hydraulic pressure releasing valve 20.

The control of tl.e opening operation of the hydraulic pressure releasing valve 20 in a condition where the intake valve 4 is in the opening and closing operation mode with the full lift in the operational region excluding the above-described specific operational regions may be conducted for every three control cycles in place of the above-described every two control cycles.

It will be understood that the controlling procedure illustrated in FIG. 4 is carried out for each cylinder by the sharing of every TDC signal, but procedures for controlling the fuel injecting time and the igniting time may be carried out according to a routine different from the routine shown in FIG. 4, and the control of the fuel injecting time and the igniting time may be conducted before or after carrying out the control according to the routine shown in FIG. 4.

Figure 6:
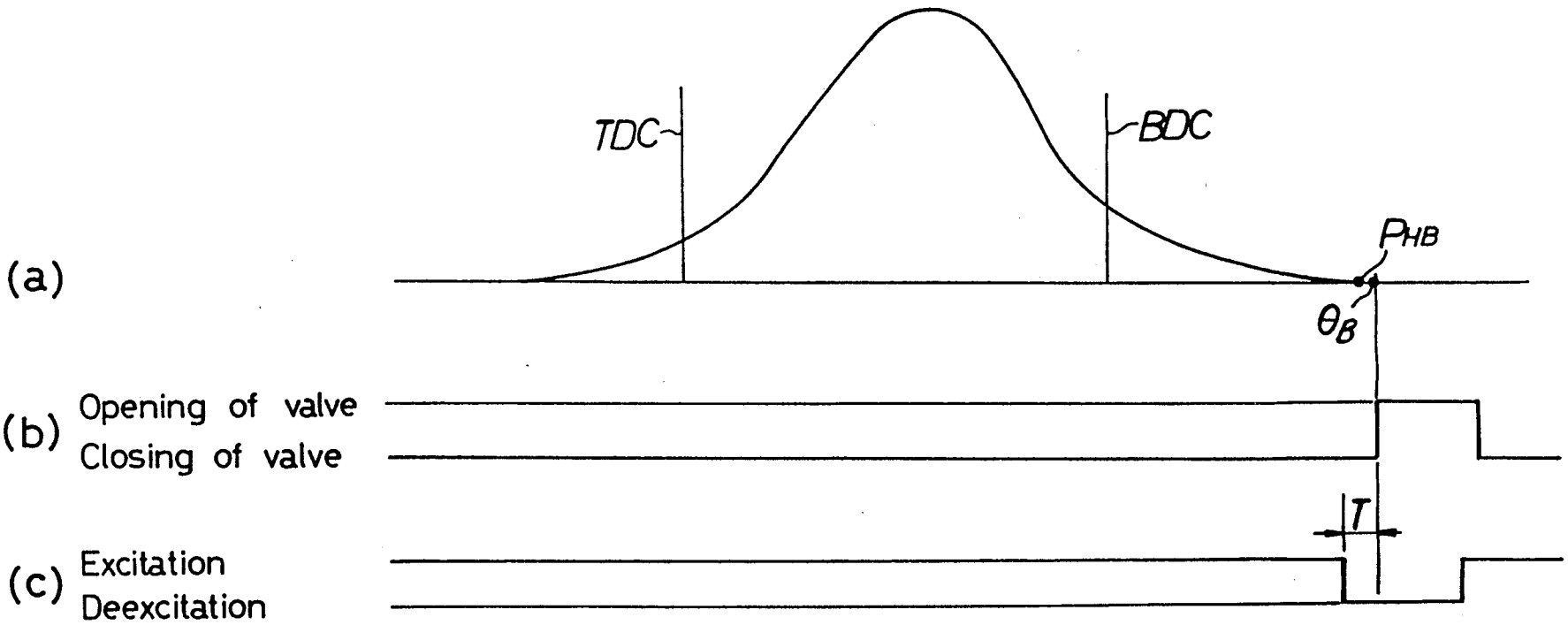
FIG. 6 is a diagram similar to FIGS. 3 and 5 illustrating the controlled valve timing under a third set of operating conditions.

FIG. 6 illustrates a timing of the control according to a third embodiment of the present invention, wherein the hydraulic pressure releasing time $\theta_B$ is basically controlled according to the above-described controlling procedure shown in FIG. 4. However, the hydraulic pressure releasing time $\theta_B$ in a specific operational region where the intake valve 4 is in the opening and closing operation mode with the full lift (i.e., in the specific operational region where the number of revolutions of the engine per minute is equal to or more than the preset number, or the specific operational region where the temperature of the working oil is equal to or less than the preset temperature, or the specific operational region where the engine is in cranking) is set at a time when the intake valve 4 is in an operational condition corresponding to the base circle portion 8*a* immediately after closing of the intake valve 4. The hydraulic pressure releasing time $\theta_A$ in an operational region excluding the above-described specific operational regions is set at a time when the intake valve 4 is in an opening and closing operation corresponding to an intermediate portion of the base circle portion 8*a*. Even according to this third set of conditions, an effect similar to that in the previous second set of conditions can be provided.

Although the use of the solenoid valve as the hydraulic pressure releasing valve 20 has been described by way of example in the above embodiments, the hydraulic pressure releasing valve 20 is not limited thereto and may be of a mechanical type. The present invention is applicable not only to the valve-operating system for the intake valve but also to a valve-operating system for an exhaust valve.

What is claimed is:

1. A valve operating system for an internal combustion engine, comprising a valve-operating can having an arcuate base circle portion with a center thereof being aligned with a rotational axis of said cam and a raised portion projecting radially outwardly from said base circle portion, a cam-side piston operatively connected to said valve-operating cam, a valve-side piston operatively connected to an engine intake valve, a hydraulic pressure chamber provide between said cam-side piston and said valve-side piston, a hydraulic pressure releasing valve connected to said hydraulic pressure chamber by an oil passage, an oil pressure supply source connected to said hydraulic pressure chamber through a check valve and said oil passage, and a control means for controlling the operation of the hydraulic pressure releasing valve in order to control closing of the intake valve through opening of the hydraulic pressure releasing valve, wherein said control means selectively opens the hydraulic pressure releasing valve to release the hydraulic pressure in said hydraulic pressure chamber immediately after substantial closing of said intake valve should have occurred according to an operational mode defined by said cam and at least in an operational position corresponding to the base circle portion of the cam, even when an opening and closing operation of said intake valve required by the engine is in a mode defined by said cam, and wherein said control means closes said hydraulic pressure releasing valve prior to a following opening mode of said intake valve defined by said cam.

2. A valve operating system for an internal combustion engine according to claim 1, wherein said intake valve performs the opening and closing operation of the mode defined by the cam when the number of revolutions of the engine per minute is at least equal to a preset revolutional number.

3. A valve operating system for an internal combustion engine according to claim 1, wherein said intake valve performs the opening and closing operation of the mode defined by the cam when the temperature of the working oil is less than a preset temperature.

4. A valve operating system for an internal combustion engine according to claim 1, wherein said intake valve performs the opening and closing operation of the mode defined by the cam when the engine is in cranking.

5. A valve operating system for an internal combustion engine according to claim 1, wherein the opening of the hydraulic pressure releasing valve by the control means is conducted for every predetermined number of control cycles.

6. A valve operating system for an internal combustion engine, comprising a cam-side piston operatively connected to a cam shaft;

a valve-side piston operatively connected to an intake valve;

a hydraulic pressure chamber provided between said cam-side piston and said valve-side piston;

an oil passage connected to said hydraulic pressure chamber for supplying oil to and extracting oil from said hydraulic pressure chamber;

a closed hydraulic pressure circuit comprising (a) a hydraulic pressure releasing valve, with a control means connected thereto, (b) an accumulator connected in sequence with said hydraulic pressure releasing valve, and (c) a first check valve connected in sequence with said accumulator and said hydraulic pressure releasing valve, wherein said first check valve only permits said oil to flow from said accumulator toward said oil passage, wherein said closed hydraulic pressure circuit is connected to said oil passage at a first junction between said first check valve and said hydraulic pressure releasing valve; and an oil pressure supply source connected through a second check valve to said closed hydraulic pressure circuit at a second junction between said accumulator and said first check valve.

* * * * *